US010598444B2

(12) United States Patent
Mabuchi et al.

(10) Patent No.: US 10,598,444 B2
(45) Date of Patent: Mar. 24, 2020

(54) HEAT EXCHANGER

(71) Applicants: DENSO CORPORATION, Kariya, Aichi-pref. (JP); DENSO THERMAL SYSTEMS S.p.A, Poirino (IT)

(72) Inventors: Shinta Mabuchi, Kariya (JP); Hajime Sugito, Kariya (JP); Osamu Hakamata, Kariya (JP); Marta Roberti, Turin (IT); Giuseppe Tiziano, Turin (IT)

(73) Assignees: DENSO CORPORATION, Kariya, Aichi-pref. (JP); DENSO THERMAL SYSTEMS S.P.A., Poirino, (Turin) (IT)

( * ) Notice: Subject to any disclaimer, the term of this patent is extended or adjusted under 35 U.S.C. 154(b) by 716 days.

(21) Appl. No.: 15/033,117

(22) PCT Filed: Oct. 29, 2014

(86) PCT No.: PCT/JP2014/005461
§ 371 (c)(1),
(2) Date: Apr. 29, 2016

(87) PCT Pub. No.: WO2015/064093
PCT Pub. Date: May 7, 2015

(65) Prior Publication Data

US 2016/0258693 A1 Sep. 8, 2016

(30) Foreign Application Priority Data

Oct. 30, 2013 (JP) ..... 2013-225901

(51) Int. Cl.
*F28F 9/02* (2006.01)
*F28D 1/053* (2006.01)
(Continued)

(52) U.S. Cl.
CPC ..... *F28F 9/0226* (2013.01); *F28D 1/05366* (2013.01); *F28F 1/22* (2013.01);
(Continued)

(58) Field of Classification Search
CPC ..... F28F 9/02; F28F 9/0226; F28F 9/0224; F28F 2225/08; F28F 2275/122
See application file for complete search history.

(56) References Cited

U.S. PATENT DOCUMENTS 4,331,201 A 5/1982 Hesse
6,082,439 A * 7/2000 Kato ..... F28F 9/0226 165/173

(Continued)

FOREIGN PATENT DOCUMENTS

DE 4330865 A1 3/1995
EP 0128806 * 12/1984

(Continued)

*Primary Examiner* — Eric S Ruppert
(74) *Attorney, Agent, or Firm* — Harness, Dickey & Pierce, P.L.C.

(57) ABSTRACT

A heat exchanger has a core plate connected to a tank member by clamping claws. The tank member has a waved outer surface including outer ridge portions and outer valley portions which are disposed alternately. The tank member also has a waved inner surface including inner ridge portions and inner valley portions which are disposed alternately. The outer valley portions are capable of receiving the claws. The inner ridge portion is positioned inside the outer valley portion in a width direction. The inner ridge portion is positioned between the adjacent tubes and/or between extensions of the tubes in a height direction. An inner width of the tank member regulated by the inner ridge portions is narrower than a width of the tube.

7 Claims, 5 Drawing Sheets

(51) Int. Cl.
*F28F 21/06* (2006.01)
*F28F 1/22* (2006.01)

(52) U.S. Cl.
CPC ..... *F28F 21/06* (2013.01); *F28F 21/062* (2013.01); *F28F 2225/08* (2013.01); *F28F 2275/12* (2013.01); *F28F 2275/122* (2013.01)

(56) References Cited

U.S. PATENT DOCUMENTS

| | | | |
|---|---|---|---|
| 8,181,694 | B2 | 5/2012 | Powers et al. |
| 2005/0133208 | A1 | 6/2005 | Powers et al. |
| 2011/0017435 | A1 | 1/2011 | Lesueur et al. |
| 2011/0168364 | A1 | 7/2011 | Okuyama et al. |

FOREIGN PATENT DOCUMENTS

| | | | | |
|---|---|---|---|---|
| EP | 1881289 | B1 | | 11/2009 |
| FR | 2904101 | A1 | | 1/2008 |
| JP | 01-114697 | | | 5/1989 |
| JP | 2002213840 | | * | 7/2002 |
| JP | 2005-326124 | A | | 11/2005 |
| JP | 2011511923 | A | | 4/2011 |
| JP | 2011144973 | A | | 7/2011 |

* cited by examiner

[Fig. 1]
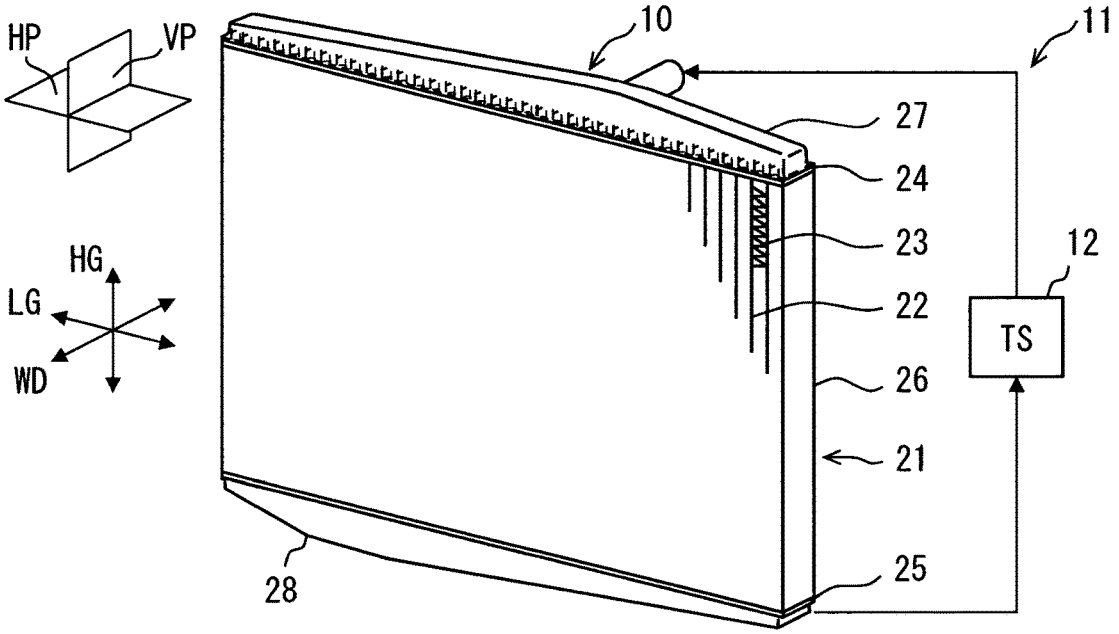
[Fig. 2]
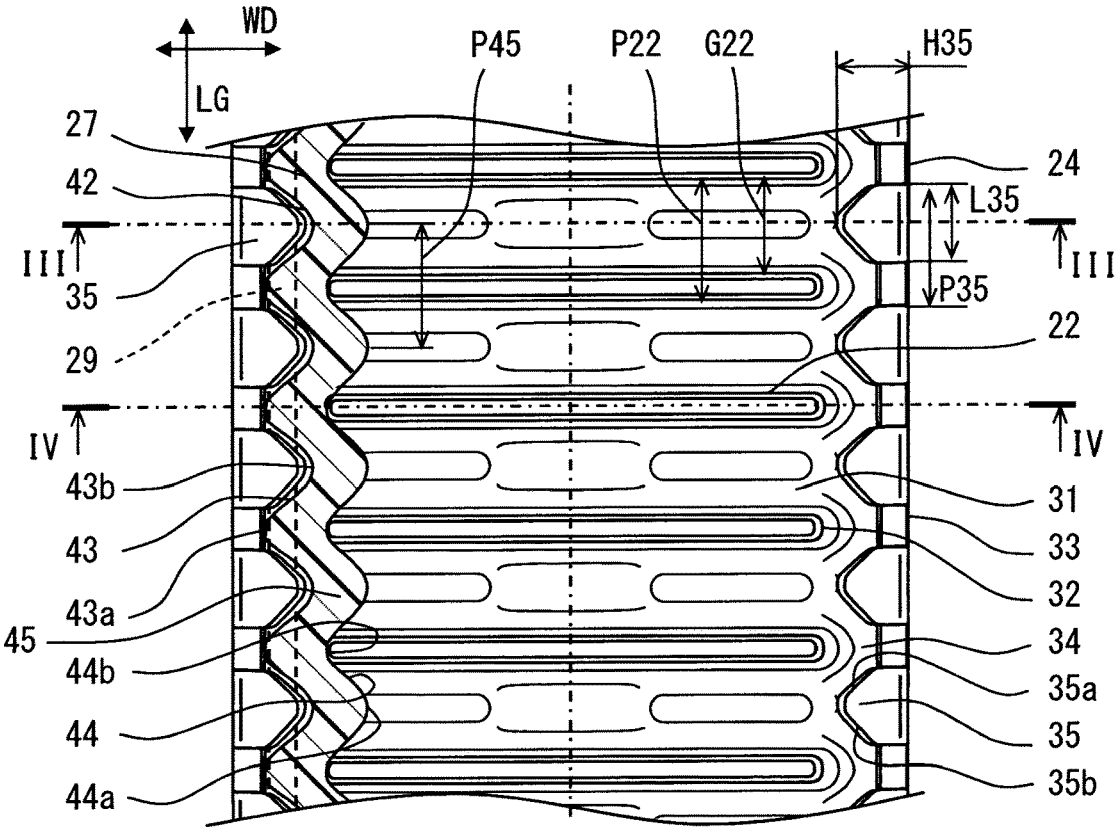

[Fig. 3]
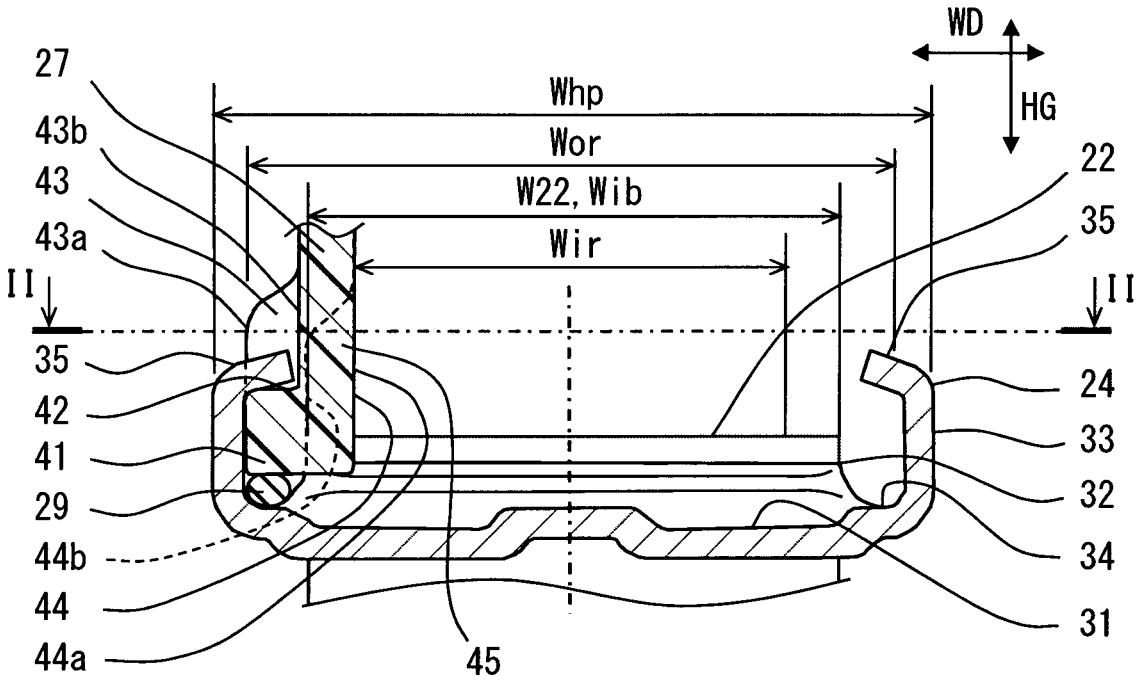
[Fig. 4]
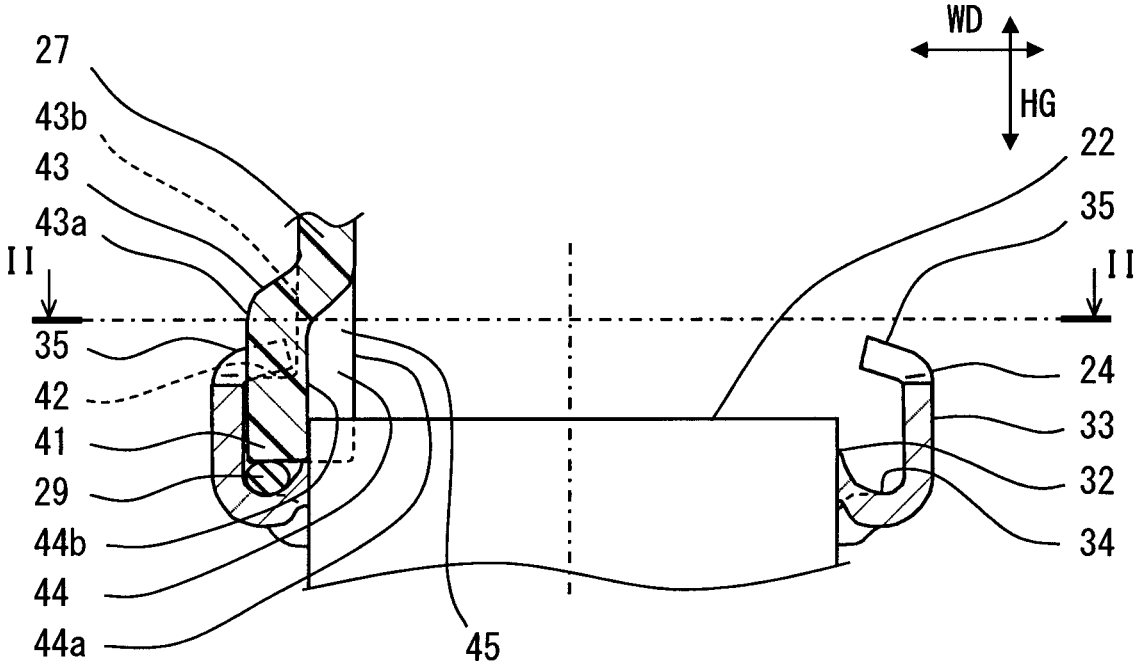

[Fig. 5]
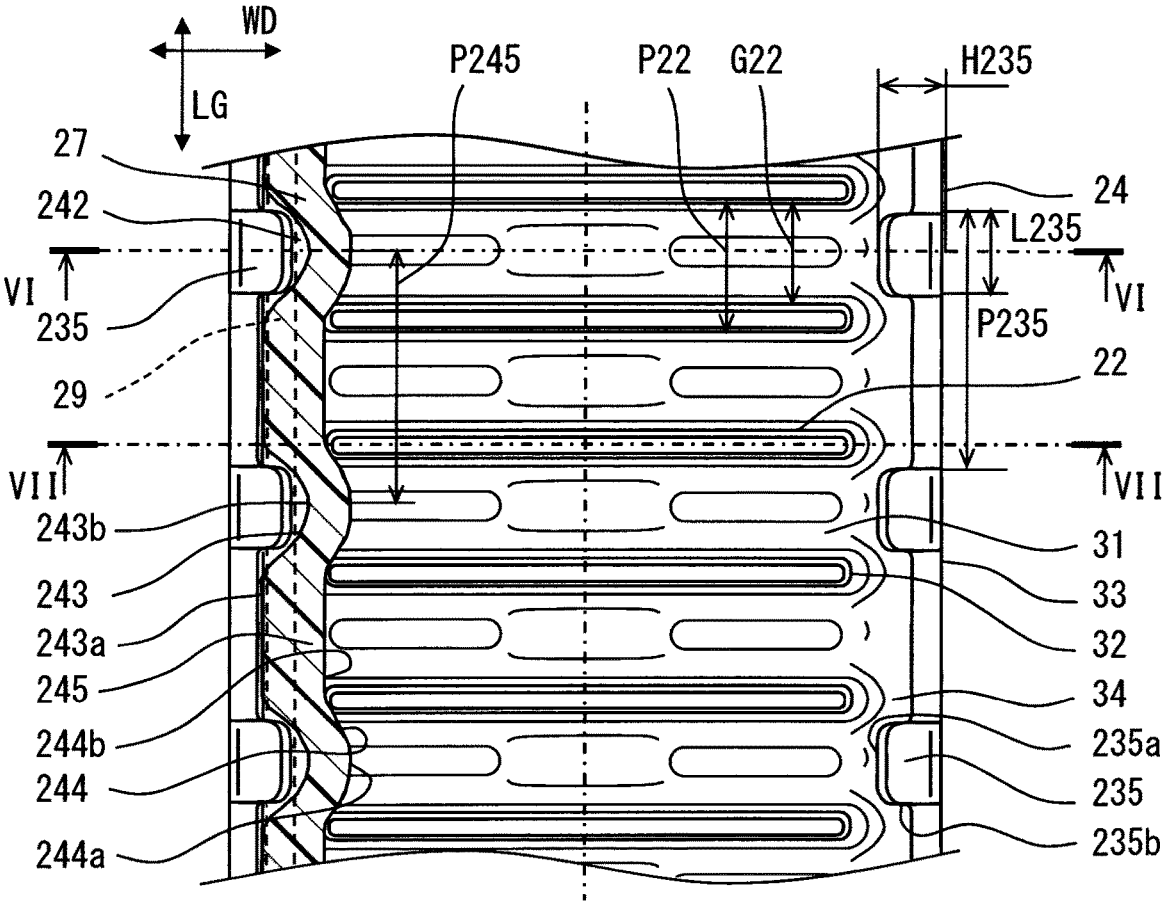

[Fig. 6]
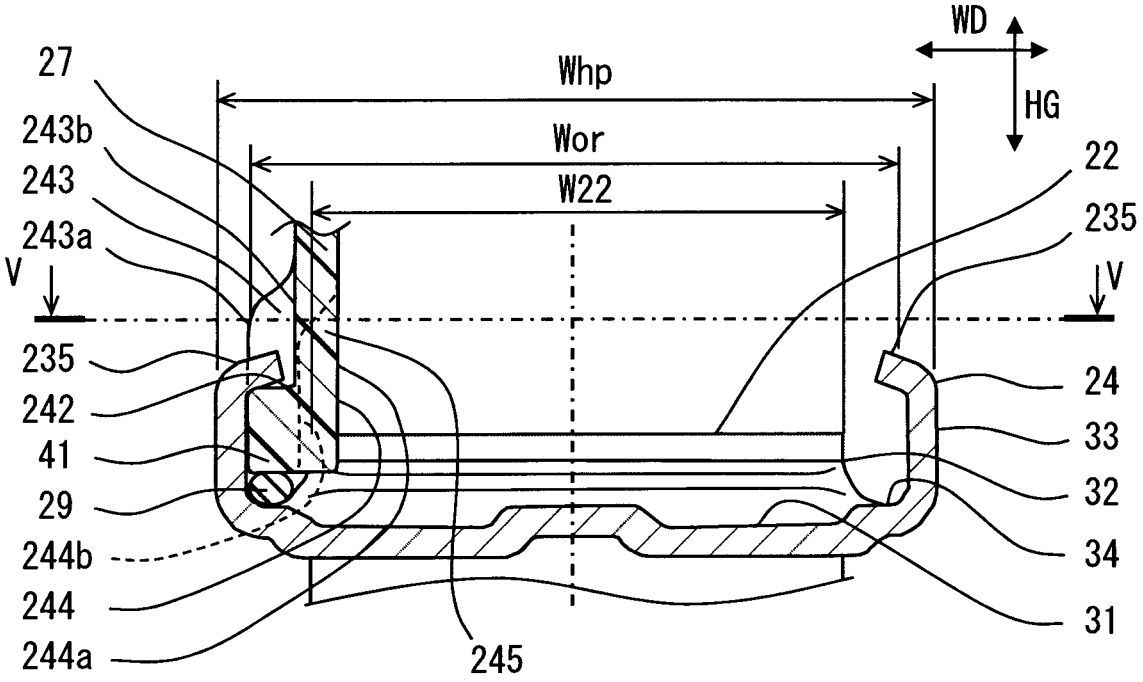
[Fig. 7]
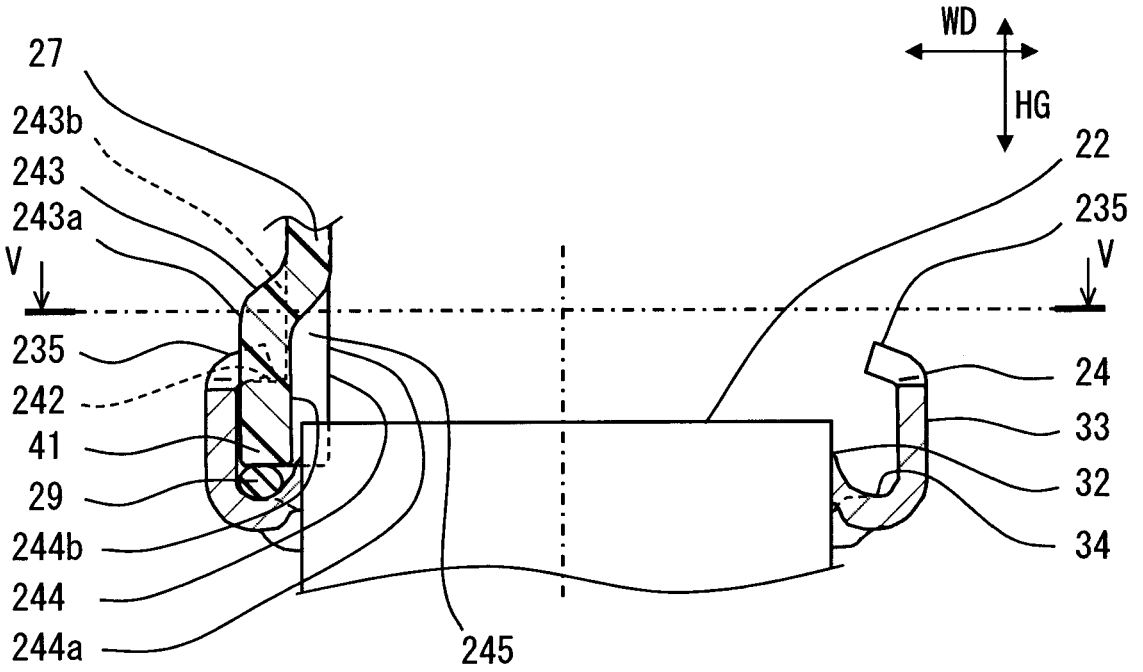

[Fig. 8]
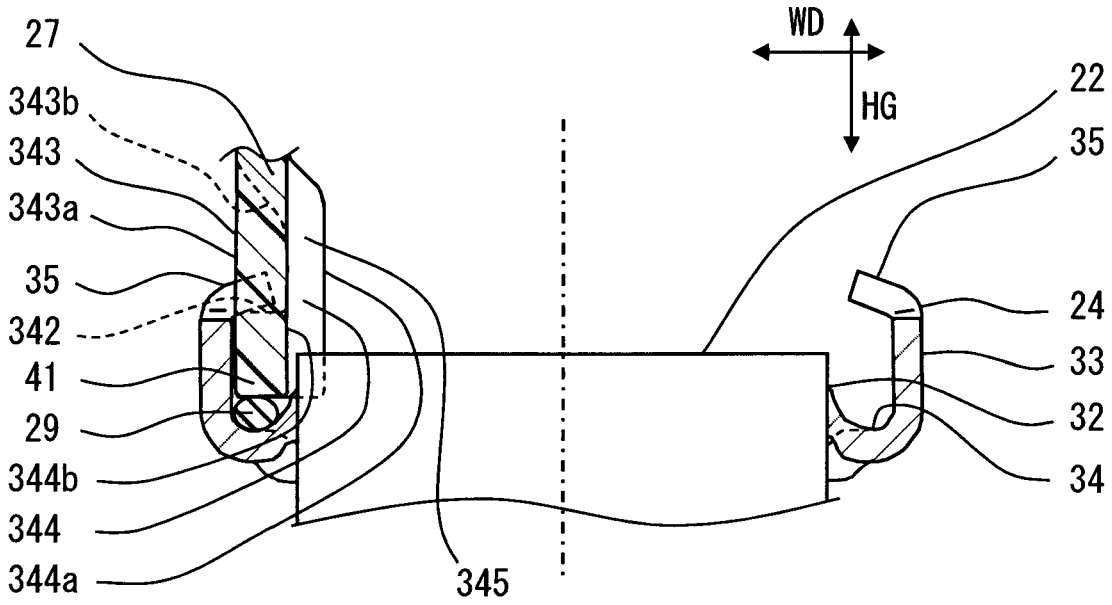
[Fig. 9]
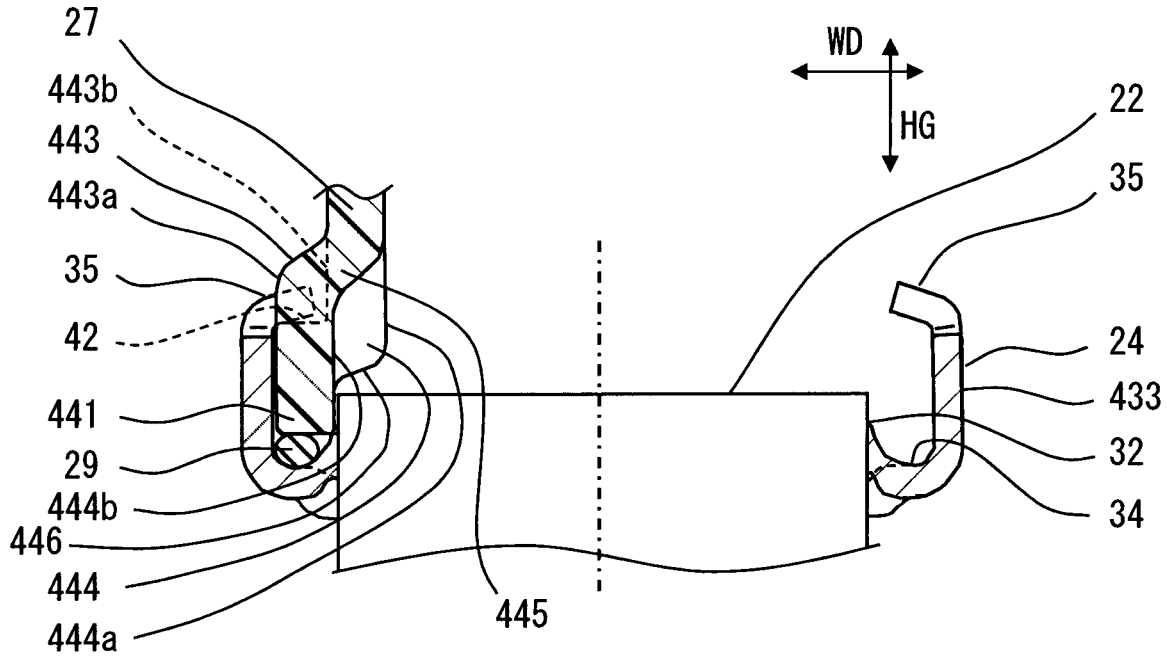

HEAT EXCHANGER

CROSS REFERENCE TO RELATED APPLICATIONS

This application is a U.S. National Phase Application under 35 U.S.C. 371 of International Application No. PCT/JP2014/005461 filed on Oct. 29, 2014 and published as WO 2015/064093 A1 on May 7, 2015. This application is based on and claims the benefit of priority from Japanese Patent Application No. 2013-225901 filed on 30 Oct. 2013 The entire disclosures of all of the above applications are incorporated herein by reference.

FIELD

The disclosure relates to a heat exchanger.

BACKGROUND

PTL1, PTL2 and PTL3 disclose a heat exchanger. These heat exchangers have a tank portion. The tank portion is formed of a core plate and a tank member. The tank member and the core plate are connected to each other by a clamping section. The clamping section is provided with an edge of the tank member and an edge of the core plate. The edge of the core plate is subjected to deformation processing so as to wrap an edge of a housing. On the edge of the core plate, a bendable section called a claw is provided. On the edge of the tank member, a step difference portion that receives the claw is provided. The claw is bent to hold the edge of the tank member.

CITATION LIST

Patent Literature

PTL1
Patent JP2011-511923A
PTL2
U.S. Pat. No. 8,181,694B
PTL3
Patent EP1881289B

SUMMARY

In a configuration of the related art, in order to avoid interference between a wall of a tank portion and a tube, at a position away from an end surface of the tube in a width direction, the tank portion and the core plate are fixed to each other by a clamping section. Moreover, the thickness of the wall of the tank portion needs to be set at a predetermined thickness for demands of performance in durability and the like. For this reason, it is difficult to narrow a width of the tank portion that is formed on an end portion of a heat exchanger. From the above-described viewpoint, or from other viewpoints not mentioned, a further improvement in heat exchangers is required.

An object of the disclosure is to provide a heat exchanger having a tank portion with a narrow width.

Another object of the disclosure is to provide a heat exchanger having a clamping section capable of a firm hold.

Another object of the disclosure is to provide a heat exchanger having a clamping section capable of a firm hold and a tank portion with a narrow width, which are compatible with each other.

Another object of the disclosure is to provide a heat exchanger having a tank portion the width of which is close to a width of a tube.

The disclosure herein employs the following technical means in order to achieve the above objects. The claims and the reference numerals in parentheses stated in the claims indicate corresponding relationships with the specific means described in the following embodiments and are not intended to limit the technical scope of the disclosure.

According to one of the disclosure, there is provided a heat exchanger. The heat exchanger includes a plurality of tubes; core plates to which the plurality of tubes are bonded; and tank members connected to the core plates, in which an edge of the core plate and an edge of the tank member are connected to each other by a clamping section. The clamping section has a plurality of claws provided on the edge of the core plate, an edge portion provided on an opening end of the tank member, and a waved wall provided in the tank member along a length direction in a wave shape. The waved wall has a waved outer surface that is provided on an outer surface above the edge portion and that includes a plurality of outer ridge portions and a plurality of outer valley portions which are disposed alternately, and a waved inner surface that is provided on an inner surface of the tank member and that includes a plurality of inner ridge portions and a plurality of inner valley portions which are disposed alternately. The plurality of outer valley portions are capable of receiving the claw and have a step difference portion in contact with the claw, which is formed on the edge portion. The inner ridge portion is positioned inside the outer valley portion in a width direction. The inner ridge portion is positioned between the adjacent tubes and/or between the tubes in an extension of the tube in a height direction. An inner width of the tank member regulated by the inner ridge portion is narrower than a width of the tube.

According to this configuration, the claw is received by the outer valley portion therein. Moreover, the outer valley portion has the step difference portion in contact with the claw, which is formed on the edge portion. It is possible to properly set a thickness of a wall of the tank member by having the inner ridge portion to be positioned inside the outer valley portion. The inner ridge portion is positioned between the adjacent tubes and/or between the tubes in the extension of the tube. Accordingly, excessive interference of the inner ridge portion and the tube is avoided.

BRIEF DESCRIPTION OF DRAWINGS

The drawings described herein are for illustration purposes only and are not intended to limit the scope of the present disclosure in any way.

FIG. 1 is a perspective view of a heat exchanger according to a first embodiment.

FIG. 2 is a cross-sectional view illustrating a horizontal cross section of a tank portion in the first embodiment.

FIG. 3 is a cross-sectional view illustrating a vertical cross section of the tank portion in the first embodiment.

FIG. 4 is another cross-sectional view illustrating a vertical cross section of the tank portion in the first embodiment.

FIG. 5 is a cross-sectional view illustrating a horizontal cross section of the tank portion in a second embodiment.

FIG. 6 is a cross-sectional view illustrating a vertical cross section of the tank portion in the second embodiment.

FIG. 7 is another cross-sectional view illustrating a vertical cross section of the tank portion in the second embodiment.

FIG. 8 is a cross-sectional view illustrating a vertical cross section of the tank portion in a third embodiment.

FIG. 9 is a cross-sectional view illustrating a vertical cross section of the tank portion in a fourth embodiment.

DESCRIPTION OF EMBODIMENTS

With reference to the drawings, multiple embodiments to embody the disclosure will be described. In each of the embodiments, the same reference numerals are applied to portions corresponding to the described matter in the preceding embodiments, and overlapping descriptions may be omitted. In addition, in the succeeding embodiments, reference numerals having numbers differing in only the hundreds or higher digits are applied to portions corresponding to the described matter in the preceding embodiments to describe the corresponding relationship therebetween, and the overlapping descriptions may be omitted. In each of the embodiments, if the description is given for only partial portions of the configuration, it is possible to apply the description of other embodiments for the remaining portions of the configuration.

First Embodiment

In FIG. 1, a heat exchanger 10 provides a heat exchange between an internal fluid and an external fluid. The heat exchanger 10 is a component of a heat system 11. The heat system 11 includes a heat apparatus (TS) 12 supplying a high-temperature internal fluid or a low-temperature internal fluid.

An example of the external fluid is air. An example of the internal fluid is a liquid. The heat exchanger 10 functions, for example, as a heat radiator to radiate waste heat supplied from the heat apparatus 12 to the atmosphere. In addition, the heat exchanger 10 functions as a cooler to cool off air using a low-temperature liquid supplied from the heat apparatus 12.

An example of the heat system 11 is a coolant circulation system mounted on vehicles. In this case, the heat apparatus 12 is a heating apparatus such as an internal-combustion engine or an inverter. As a typical example thereof, the heat exchanger 10 is a radiator for vehicles to radiate heat from a coolant for cooling off the internal-combustion engine to air outside the vehicle.

The heat exchanger 10 includes a core 21 to carry out heat exchange. The core 21 is in a plate shape spreading along a height direction HG and a length direction LG and being thin in a width direction (thickness direction) WD. The core 21 has a plurality of tubes 22; a plurality of fins 23; core plates 24 and 25; and a gasket 29. Components configuring the core 21 are bonded to each other by soldering. The heat exchanger 10 includes the tank members 27 and 28.

The core 21 includes the plurality of tubes 22. Each of the tubes 22 is made of metal such as an aluminum alloy. The tube 22 is a tube both ends of which are open. The tube 22 extends along the height direction HG in a long manner. A longitudinal direction of the tube 22 corresponds to the height direction HG. A cross section of the tube 22 vertical to the longitudinal direction is in a flat shape. In the illustrated example, the tube 22 is a flat tube having an elliptical-shaped cross section. The longitudinal direction of an end surface and/or the cross section of the tube 22 corresponds to the width direction WD.

The plurality of tubes 22 are arranged in parallel to each other. The plurality of tubes 22 are disposed to be parallel in their plane surface. The plurality of tubes 22 are disposed being separated from each other by a predetermined distance. Inside the plurality of tubes 22, there is formed a path for the internal fluid. Between the plurality of tubes 22, there is formed a path for the external fluid.

The core 21 has the plurality of fins 23. Each of the fins 23 is made of the metal such as the aluminum alloy. The fin 23 is a thin aluminum alloy plate formed in a wave shape. The fin 23 is also called a corrugated fin. The fin 23 is disposed between two tubes 22 that are positioned to be adjacent to each other. The fin 23 is thermally in contact with the tube 22. The fin 23 promotes heat exchange outside the tube 22, that is, the heat exchange with air.

The core 21 has the core plates 24 and 25. The core plates 24 and 25 are made of the metal such as the aluminum alloy. The core plates 24 and 25 are members having a long-thin-shallow cup shape. The core plates 24 and 25 have a squared opening corners of which are round. An edge of the opening of the core plates 24 and 25 has a size capable of receiving an opening end of the below-described tank members 27 and 28 therein. In the core plates 24 and 25, a size in the length direction LG is larger than a size in the width direction WD. The core plates 24 and 25 extend along the length direction LG in a long and thin manner. The size in the width direction WD of the core plates 24 and 25 is close to a size in the width direction WD of the tube 22, but is slightly larger.

A core plate 24 is positioned at an end portion of the plurality of tubes 22. The plurality of tubes 22 are disposed to pass through the core plate 24. The plurality of tubes 22 are bonded to the core plate 24 by soldering and are fixed thereto. The other core plate 25 is positioned at the other end portion of the plurality of tubes 22. The plurality of tubes 22 are disposed to pass through the core plate 25. The plurality of tubes 22 are bonded to the core plate 25 by soldering and are fixed thereto.

The core 21 has a side plate 26. The side plate 26 is made of the metal such as the aluminum alloy. The side plate 26 is disposed at an end portion of the core 21. The side plate 26 is disposed at an end portion of the plurality of tubes 22 and the plurality of fins 23 that are disposed in a stacked manner. The side plate 26 improves an intensity of the core 21.

The tank members 27 and 28 are made of a resin. The tank portions 27 and 28 are also called a resin tank. The tank members 27 and 28 are members having a long-thin cup shape. The tank members 27 and 28 have a squared opening corners of which are round. An edge of the opening of the tank members 27 and 28 has a size capable of being inserted into the opening of the core plates 24 and 25. In the tank members 27 and 28, a size in the length direction LG is larger than a size in the width direction WD. The tank members 27 and 28 extend along the length direction LG in a long and thin manner. The size in the width direction WD of the tank members 27 and 28 is close to the size in the width direction WD of the tube 22, but is slightly larger.

The tank members 27 and 28 define a tank portion by being connected to the core 21. More specifically, the tank members 27 and 28 define the tank portion by being connected to the core plates 24 and 25. The tank portion provides a distribution tank distributing the internal fluid to the plurality of tubes 22 and/or a gathering tank gathering the internal fluid from the plurality of tubes 22. The tank members 27 and 28 have an inlet and an outlet for the internal fluid at an arbitrary position.

The core plates 24 and 25 and the tank members 27 and 28 are positioned such that the core plates 24 and 25 cover the opening of the tank members 27 and 28, thereby being connected. The core plates 24 and 25 and the tank members 27 and 28 are connected to each other by a clamping section formed by an edge of an outer periphery portion of the core plates 24 and 25 and an edge of the opening of the tank members 27 and 28. The core plates 24 and 25 and the tank members 27 and 28 are connected to each other by only the clamping section.

In order to form the clamping section, the core plates 24 and 25 have an accommodation portion receiving the edge of the opening of the tank members 27 and 28. In order to form the clamping section, the core plates 24 and 25 have the plurality of claws to hold the edge of the opening of the tank members 27 and 28. In order to form the clamping section, the tank members 27 and 28 have a step difference portion receiving the plurality of claws of the core plates 24 and 25 and abutting on the plurality of claws. The plurality of claws of the core plates 24 and 25 hold the edge of the tank members 27 and 28 and are deformed to abut on the step difference portion. Accordingly, the core plates 24 and 25 and the tank members 27 and 28 are connected to each other.

An upper tank portion formed by the core plate 24 and the tank member 27 and a lower tank portion formed by the core plate 25 and the tank member 28 have the same shape. In the following description, the upper tank portion will be mainly described.

FIG. 2 illustrates a cross section indicated by the line II-II in FIGS. 3 and 4 and parallel to a horizontal plane HP. FIG. 3 illustrates a cross section parallel to a vertical plane VP and indicated by the line III-III in FIG. 2. FIG. 3 is the cross section of a position where the tube 22 is absent. FIG. 4 illustrates a cross section parallel to the vertical plane VP and indicated by the line VI-VI in FIG. 2. FIG. 4 is the cross section of a position where the tube 22 is present. In FIGS. 2 to 4, a cross section including the tank member 27 is illustrated in the left half portion, and a cross section in which the tank member 27 is removed is illustrated in the right half portion.

In FIGS. 2 to 4, the heat exchanger 10 has the gasket 29. The gasket 29 is made of rubber or the resin. The gasket 29 is in a quadrangular ring shape. The gasket 29 is disposed between the core plate 24 and the tank member 27. The gasket 29 is disposed between an end surface of an opening portion of the tank member 27 and the core plate 24. The gasket 29 seals a gap between the core plate 24 and the tank member 27. The gasket 29 extends straight along the length direction LG. The gasket 29 can be provided as a component independent from the core plate 24 and the tank member 27. The gasket 29 may be integrated using bonding means such as adhesion to the core plate 24 or the tank member 27.

The core plate 24 is a member in a plate shape. The core plate 24 is formed by cutting and bending a plate in a predetermined shape. The core plate 24 has a bottom plate 31 to which the tube 22 is bonded, and a lateral plate 33 rising from an edge of the bottom plate 31. The core plate 24 has a claw 35 provided on an edge of the lateral plate 33.

The core plate 24 has the long and thin-shaped bottom plate 31. In the bottom plate 31, there is provided a through hole 32 to cause the tube 22 to pass therethrough. In the bottom plate 31, there are formed numerous concave and convex shapes. For example, through hole 32 is provided in an open state at the apex portion of a convex shape bulging from the core 21 toward the inside of the tank portion. The concave and convex shapes contribute to enhancing the intensity of the bottom plate 31. The concave and convex shapes contribute to an increase of a soldering area between the through hole 32 and the tube 22.

The core plate 24 has the lateral plate 33 positioned on four sides of the bottom plate 31. The lateral plate 33 is provided to vertically rise from the four sides of the bottom plate 31. The accommodation portion to receive the tank member 27 is defined by the bottom plate 31 and the lateral plate 33. The lateral plate 33 is provided on a side of the core plate 24 in the longitudinal direction. Moreover, the lateral plate 33 is also provided on a side of the core plate 24 in a short direction. The side in the short direction is positioned on the side plate 26 of FIG. 1.

The core plate 24 has a ring-shaped sealing surface 34 along the edge of the bottom plate 31. The gasket 29 is disposed on the sealing surface 34. The sealing surface 34 is defined between the concave and convex shapes formed on the bottom plate 31 and the lateral plate 33 in a groove shape.

The core plate 24 has a plurality of claws 35. The plurality of claws 35 extend from an edge of the lateral plate 33. The claw 35 extends from the lateral plate 33 in the height direction of the lateral plate 33 and extends further inside than the lateral plate 33. The claw 35 is bent to extend further inside than the lateral plate 33. Accordingly, the claw 35 holds the edge of the tank member 27.

The claw 35 has a tapered shape being gradually tapered from the lateral plate 33 toward a tip end. The claw 35 has two oblique sides 35*a* and 35*b*. The claw 35 has a long and thin shape the tip end of which is in a triangular shape. The shape of the claw 35 can be also called a ligula shape.

A length (height) H35 of the claw 35 is set to cause the tip end of the claw 35 to reach the vicinity of the arrangement region of the tube 22. The length H35 of the claw 35 may be set to cause the tip end of the claw 35 to reach the inside of the arrangement region of the tube 35. The height H35 of the claw 35 may be set to cause the tip end of the claw 35 to reach the inside of a region between two adjacent tubes 22 when viewed in a vertical direction, that is, in FIG. 2.

The claw 35 has a thinner portion than a gap G22. A width (length) of the tip end portion of the claw 35 is smaller than the gap G22 of the plurality of tubes 22. A size L35 (also called width or length) of the claw 35 in the length direction LG in a base end portion is smaller than the gap G22 between adjacent two of the tubes 22. A thin claw facilitates interference avoidance between the tank member 27 and the tube 22. If the tube 22 and the claw 35 are projected on the horizontal plane HP, the tube 22 and the claw 35 are formed and disposed not to overlap with each other regarding the width direction WD. The triangular-shaped tip end region including the tip end of the claw 35 does not overlap with the tube 22 regarding the width direction WD. Alternatively, a width L35 can be set wider than the gap 22. In this alternative example as well, the tapered claw 35 has a thinner portion than the gap G22.

If the tube 22 and the claw 35 are projected on the horizontal plane HP, the claw 35 is provided only at a position corresponding to the gap between adjacent two of the tubes 22. In other words, in an extension in the longitudinal direction of the end surface and/or the cross section of the tube 22, that is, in the width direction WD, there is provided no claw 35.

A disposing regulation of the plurality of tubes 22 and the disposing regulation of the plurality of claws 35 are synchronous with each other. According to the disposing regulation of the plurality of tubes 22 and the disposing regulation of the plurality of claws 35, the tip end of the claw 35 and the tube 22 are out of alignment not to be aligned in a straight line along the width direction WD. Pitches P22 of the plurality of tubes 22 are regular. Pitches P35 of the plurality of claws 35 are regular. The pitch P35 of the plurality of claws 35 is equal to the pitch P22 of the plurality of tubes 22. A relationship between the pitch P35 of the claw 35 and the pitch P22 of the tube 22 is P35=P22×n. The alphabetic character n is a natural number coefficient. In this example, n is 1.

The tank member 27 has an edge portion 41 of the opening portion. The edge portion 41 is in a quadrangle ring shape. The edge portion 41 provides an end surface being in contact with the gasket 29. The end surface extends straight along the length direction LG. The gasket 29 is provided between the edge portion 41 and the core plate 24. The edge portion 41 is held by the edge of the bottom plate 31, the lateral plate 33 and the claw 35. The edge portion 41 provides a reception surface receiving the claw 35 on the end surface and the opposite side. The reception surface is provided by the below-described step difference portion 42. The edge portion 41 is part of the configuration of the clamping section.

The tank member 27 has a plurality of step difference portions 42. The step difference portion 42 is formed on an outer surface of the tank member 27. The step difference surface 42 is provided at a position separated away from the end surface of the tube 22 in the height direction HG. Regarding the width direction WD, the step difference surface 42 is provided to be positioned further outside than the tube 22 and an extension region thereof in the longitudinal direction.

The step difference portion 42 is provided by a concave portion capable of receiving the claw 35. The step difference portion 42 provides a reception surface on which the claw 35 abuts. The step difference portion 42 provides a protrusion portion held by the claw 35 on an edge of the opening end of the tank member 27. The claw 35 abuts on the step difference portion 42, thereby forming the clamping section. As a result, the core plate 24 and the tank member 27 are connected to each other.

The tank member 27 has a waved outer surface 43. The waved outer surface 43 provides a plurality of concave portions, that is, the plurality of step difference portions 42. The waved outer surface 43 is formed on the outer surface of the tank member 27. The waved outer surface 43 is formed further upward than the edge portion 41. The waved outer surface 43 provides the plurality of step difference portions 42 by being concave further toward an inner side than the edge portion 41.

The waved outer surface 43 has an outer ridge portion 43*a* and an outer valley portion 43*b*. An outer width Wor in the width direction WD regulated by the outer ridge portion 43*a* is equal to a width regulated by the edge portion 41. The outer valley portion 43*b* is concave further toward the inside than the edge portion 41. The outer valley portion 43*b* partitions the step difference portion 42. The outer valley portion 43*b* provides a depth capable of receiving the claw 35. Accordingly, a plurality of outer valley portions 43*b* are capable of receiving the claw 35, and form the step difference portions 42 with which the claws are in contact on the edge portion 41.

The waved outer surface 43 is formed on only a partial range of the tank member 27 in the height direction. The waved outer surface 43 extends for a predetermined height from the edge portion 41 along the height direction HG. The outer ridge portion 43*a* and the outer valley portion 43*b* extend along the height direction HG. The outer ridge portion 43*a* becomes gradually lower. The outer ridge portion 43*a* has the same height as the outer valley portion 43*b* at a position separated away for a predetermined distance from the edge portion 41. The outer valley portion 43*b* has the same width as an upper portion of the tank member 27.

The tank member 27 has a waved inner surface 44. The waved inner surface 44 is formed on an inner surface of the tank member 27. The waved inner surface 44 is also formed on an inner side of the edge portion 41. The waved inner surface 44 protrudes further toward the inside than the edge portion 41.

The waved inner surface 44 has an inner ridge portion 44*a* and an outer valley portion 44*b*. A depth of the inner ridge portion 44*a* is equal to an inner surface of the upper portion of the tank member 27. The inner valley portion 44*b* is equal to the inner surface of the edge portion 41.

The waved inner surface 44 is formed on only the partial range of the tank member 27 in the height direction HG. The waved inner surface 44 is formed further inside the waved outer surface 43 in the width direction WD. Regarding the height direction HG, the waved inner surface 44 is formed across a wider range than the waved outer surface 43. The waved inner surface 44 extends for a predetermined height from the edge portion 41 along the height direction HG. The inner ridge portion 44*a* and the inner valley portion 44*b* extend along the height direction HG. Regarding the length direction, a portion of the inner ridge portion 44*a* is positioned to overlap with the tube 22. In FIGS. 3 and 4, regarding an illustrated direction, that is, regarding the length direction LG, a lower end corner portion of the inner ridge portion 44*a* is positioned to overlap with a corner portion of the tube 22. Moreover, if there is a tube in an extension of the tube 22 as well, the inner ridge portion 44*a* is positioned to overlap with the tube 22. The inner ridge portion 44*a* is positioned between adjacent two of the tubes 22 and in the extension thereof. Accordingly, the inner ridge portion 44*a* is capable of providing a wall having a necessary thickness inside the step difference portion 42. Besides, the inner ridge portion 44*a* avoids the interference with the tube 22.

The inner valley portion 44*b* becomes gradually shallow as it is separated from the edge portion 41. The inner valley portion 44*b* has the same width as the inner ridge portion 44*a* at a position separated by a predetermined distance from the edge portion 41. The waved inner surface 44 extends to cover the end surface of the tube 22 in an extension of the end surface of the tube 22.

As illustrated in FIG. 2, the waved outer surface 43 and the waved inner surface 44 form a waved wall 45 therebetween. In other words, the waved wall 45 is provided on an outer surface above the edge portion 41 and has the waved outer surface 43 including a plurality of outer ridge portions 43*a* and a plurality of outer valley portions 43*b* that are alternately disposed. The waved wall 45 is provided on an inner surface of the tank members 27 and 28 and has the waved inner surface 44 including a plurality of inner ridge portions 44*a* and a plurality of inner valley portions 44*b* that are alternatively disposed.

The outer ridge portion 43*a* and the inner valley portion 44*b* are positioned to be aligned along the width direction WD. The outer valley portion 43*b* and the inner ridge portion 44*a* are positioned to be aligned along the width direction WD. The waved wall 45 provides the outer valley portion 43*b* receiving the claw 35 outside thereof, thereby forming the step difference portion 42. In addition, the waved wall 45 provides inside thereof the inner valley portion 44*b* suppressing the interference with the tube 22 and the inner ridge portion 44*a* extending to the gap of the tubes 22. Moreover, the waved wall 45 enhances rigidity of the tank member 27. The waved wall 45 contributes to suppressing a deformation of the edge portion 41.

A pitch P45 of the waved wall 45 is equal to the pitch P35 of the claw 35. The pitch P45 of the waved wall 45 is equal to the pitch P22 of the tube 22. A relationship between the pitch P45 of the waved wall 45 and the pitch P22 of the tube 22 is P45=P22×n. The alphabetic character n is a natural number coefficient. In this example, n is 1. The pitch P45 is also a pitch of the step difference portion 42, the waved outer surface 43 and the waved inner surface 44.

As illustrated in FIG. 3, an inner width Wib regulated by the inner valley portion 44*b* is slightly wider than a width W22 of the tube 22. A portion of the plurality of inner valley portions 44*b* sometimes may come into contact with an end portion of the tube 22. It is preferable that a minute chink is formed between the inner valley portion 44*b* and the end portion of the tube 22. The inner valley portion 44*b* avoids the excessive interference between the tube 22 and the tank member 27. A length of the inner valley portion 44*b* in the height direction HG is longer than a protruding amount of the tube 22 so as to avoid the interference with the tube 22. The inner valley portion 44*b* is positioned outside the tube 22 in the width direction WD to receive the tube 22 therein.

The inner width Wir regulated by the inner ridge portion 44*a* is equal to an internal gap regulated by the upper portion of the tank member 27. The inner width Wir is smaller than the width W22 of the tube 22. That is, the inner ridge portion 44*a* is positioned between adjacent two of the tubes 22. Moreover, in the extension of the tube 22 in the height direction HG, the inner ridge portion 44*a* is positioned between two of the tubes 22. According to this configuration, it is possible to set the inner width Wir of the tank member 27 to be narrower than the width W22 of the tube 22. As a result, it is possible to cause an outer width of the tank member 27 to be narrow while giving a proper thickness to the wall of the tank member 27.

The inner ridge portion 44*a* is formed inside the outer valley portion 43*b* in the width direction WD. The outer valley portion 43*b* is concave further toward the inside than the edge portion 41 to provide the step difference portion 42. Regarding the width direction WD, inside the outer valley portion 43*b*, the inner ridge portion 44*a* is capable of maintaining a necessary thickness of the wall of the tank member 27.

According to the heat exchanger 10, the clamping section connecting the core plate 24 and the tank member 27 has the plurality of claws 35 provided on the edge of the core plate 24 and the edge portion 41 provided on the edge of the opening end of the tank member 27. Moreover, the clamping section has the waved wall 45 provided in a wave shape along the tank member 27 in the length direction LG.

The edges on both sides of the core plate 24 in the width direction WD are formed in a symmetrical manner. The edges on both sides of the tank member 27 in the width direction WD are formed in the symmetrical manner.

Returning to FIG. 1, the claw 35 and the waved wall 45 are provided on only a side extending along the length direction LG of the core plate 24 and the tank member 27. On the side extending along the width direction WD of the core plate 24 and the tank member 27, there is provided the clamping section including the claw and the step difference portion which are independent from the pitch of the tube 22. A shape of these claws is formed being independent from the pitch of the tube 22. These claws are, for example, in a rectangular shape. A claw having the same shape as the claw 35 may be provided on the upper side of the lateral plate 33 in the short direction. Accordingly, in a preferable embodiment, the core plate 24 includes the plurality of claws 35 on the side extending along at least the length direction LG.

In preparing the core plate 24, the claw 35 is formed so as to rise in parallel with the lateral plate 33. Next, in assembling, the core plate 24 and the tank member 27 are assembled. The tank member 27 is inserted into the core plate 24. Thereafter, clamping is carried out. In the clamping, the plurality of claws 35 are bent to be in the illustrated shape. The plurality of claws 35 are bent to cover the step difference portion 42 of the tank member 27 and further to abut on the step difference portion 42. Accordingly, the clamping section is formed. As a result, the core plate 24 and the tank member 27 are connected to each other, thereby defining the tank portion. The core plate 25 and the tank member 28 are connected to each other by the same manufacturing method.

According to this configuration, the claws 35 are received by the outer valley portions 43*b*. Moreover, the outer valley portion 43*b* forms the step difference portion 42 with which the claw 35 is in contact above the edge portion 41. The inner ridge portion 44*a* is provided inside the outer valley portion 43*b*. The inner ridge portion 44*a* is positioned between the adjacent tubes 22. Accordingly, the excessive interference between the inner ridge portion 44*a* and the tube 22 is avoided. Therefore, it is possible to position the claw 35 deep inside the step difference portion 42 while suppressing the interference between the end portion of the tube 22 and the tank member 27. The inner ridge portion 44*a* is positioned inside the outer valley portion 43*b*, and thus, it is possible to properly set the thickness of the wall of the tank members 27 and 28. Moreover, a width of the tank portion regulated by an outer width Whp of the core plate 24 and/or the outer width Wor of the tank member 27 can be close to the width W22 of the tube 22.

Second Embodiment

This embodiment is a modification example having the preceding embodiment as an essential embodiment. In the above embodiment, the pitch of each portion is set as P22=P35=P45. In place of this, it may be set as P22×n=P35=P45. However, the alphabetic character n is a natural number coefficient of 2 or more.

FIGS. 5, 6 and 7 are cross-sectional views corresponding to FIGS. 2, 3 and 4, respectively. In the drawings, the core plate 24 has a plurality of claws 235. The claw 235 is in a rectangular shape having rounded corners. The claw 235 has a top side 235*a* parallel to the length direction LG and a lateral side 235*b*. The claw 235 has a width L235. The claw 235 has a length (height) H235. The claw 235 can be also called a quadrangle. The plurality of claws 235 are provided in an equal gap of a pitch P235. The pitch P235 is twice the pitch P22 of the tube 22.

The tank member 27 has the plurality of step difference portions 242 corresponding to positions of the plurality of claws 235. The tank member 27 has a waved outer surface 243. An outer ridge portion 243*a* is in a plane shape extended long along the length direction LG. An outer valley portion 243*b* has a size capable of receiving the claw 235. The outer valley portion 243*b* provides the step difference portion 242. The tank member 27 has a waved inner surface 244. The inner ridge portion 244*a* is positioned between adjacent two of the tubes 22. Regarding the width direction WD, the inner ridge portion 244*a* is positioned inside the outer valley portion 243*b*, that is, the step difference portion 242. An inner valley portion 244*b* is in the plane shape extended long along the length direction LG. A waved wall 245 is formed in a pitch P245.

In this embodiment, the pitch of each portion is P22×2=P235=P245. Accordingly, the pitch P235 of the plurality of claws 235 and the pitch P245 of the waved wall 245 are as wide as a natural number coefficient n times the pitch P22 of the plurality of tubes 22. In this configuration as well, it is possible to acquire the same effect as in the above-described embodiment.

Third Embodiment

This embodiment is another modification example having the preceding embodiments as an essential embodiment. In the above embodiments, the step difference portions 42 and 242 are provided so as to protrude outwardly from the tank member 27. In place of this, a step difference portion may be provided so as to be concave from the tank member 27 toward the inside.

FIG. 8 is a cross-sectional view corresponding to FIG. 4. In the drawing, the tank member 27 has a plurality of step difference portions 342 corresponding to positions of the plurality of claws 35. The tank member 27 has a waved outer surface 343. The waved outer surface 343 is formed so as to be concave from the outer surface of the tank member 27 toward the inside. An outer ridge portion 343*a* has the same height as the edge portion 41. An outer valley portion 343*b* is concave further toward the inside than the edge portion 41. The outer valley portion 343*b* has a size capable of receiving the claw 35. The outer valley portion 343*b* provides the step difference portion 342.

The tank member 27 has a waved inner surface 344. An inner ridge portion 344*a* is positioned between adjacent two of the tubes 22. The inner ridge portion 344*a* is positioned inside the outer valley portion 343*b*, that is, the step difference portion 342. An inner valley portion 344*b* is formed so as to suppress the interference with the tube 22.

In this embodiment, a waved wall 345 is formed so as to protrude toward the inside of the tank member 27. In this configuration as well, it is possible to acquire the same effect as in the above-described embodiments.

Fourth Embodiment

This embodiment is another modification example having the preceding embodiments as an essential embodiment. In the above embodiments, the inner ridge portion 44*a*, 244*a* or 344*a* is positioned between adjacent two of the tubes 22. In place of this, in this embodiment, an inner ridge portion 444*a* is positioned between adjacent two of the tubes 22 in only the extension of the tube 22.

FIG. 9 is a cross-sectional view corresponding to FIG. 4. The core plate 24 includes a lateral plate 433 that is slightly higher than the lateral plate 33 of the preceding embodiment. The lateral plate 433 is set to be able to hold an edge portion 441 of the tank member 27.

The tank member 27 has the edge portion 441 that is slightly higher than the edge portion 41 of the preceding embodiment. The edge portion 441 is formed to be high so as to avoid the interference with the tube 22. The tank member 27 has a waved outer surface 443. The waved outer surface 443 has an outer ridge portion 443*a* and an outer valley portion 443*b*. The outer valley portion 443*b* is capable of receiving the claw 35. The outer valley portion 443*b* forms the step difference portion 42.

The tank member 27 has a waved inner surface 444. The inner ridge portion 444*a* is positioned between two of the tubes 22 in the extension of the tube 22. The inner ridge portion 444*a* is formed so as to be positioned only above the tube 22. The inner ridge portion 444*a* has an expansion portion 446 developed toward the outside as being closer to an end surface of the opening end of the tank member 27. As a result, regarding the width direction WD, there is provided only the edge portion 41 in a position overlapping with the tube 22. In this configuration, regarding the length direction LG, that is, regarding an illustrated direction in FIG. 9, the inner ridge portion 444*a* and the tube 22 do not overlap with each other.

In this embodiment, the tube 22 and the inner ridge portion 444*a* do not overlap along the length direction LG. However, in this embodiment as well, in the extension of the tube 22, the inner ridge portion 444*a* is positioned between adjacent two of the tubes 22. The inner ridge portion 444*a* is not positioned between adjacent two of the tubes 22. However, the inner ridge portion 444*a* is positioned between two of the tubes 22 in the extension of the tube 22 in the height direction HG. An inner valley portion 444*b* provides a space in the extension of the tube 22 in the height direction HG. Accordingly, it is possible to reliably avoid the interference between the tank member 27 and the tube 22 while setting the thickness of the wall of the tank member 27 to a necessary thickness. As a result, it is possible to provide the step difference portion 42 for the clamping section inside.

Other Embodiment

In the above embodiments, the pitches of the claw and the waved wall are set to be the same as or twice the pitch of the tube 22. In place of this, the pitches may be set to three times, four times or more the pitch of the tube 22 to be employed. When seeking a solid connection between the tank member 27 and the core plate 24, it is preferable that the pitches of the claw and the waved wall are the same as or twice the pitch P22 of the tube 22.

In addition, in the above embodiments, the plurality of claws 35 and the plurality of step difference portions 42 are provided with identical numbers. In addition, the same pitch is employed in the entirety of the above embodiments. In place of this, the number of the plurality of claws 35 may be decreased partially or in its entirety. For example, in place of the plurality of claws 35 of the first embodiment, half the number of the claws 35 may be provided therein. In this case, the number of the step difference portions 42 provided in the tank member 27 is twice the number of the claws 35. In addition, a plurality of pitches may be employed. For example, the claws 35 and the step difference portions 42 are provided in a partial range above the core plate 24 and/or the tank member 27 in a first pitch. In the remaining range, the claws 35 and the step difference portions 42 are provided in a second pitch different from the first pitch. In this case, the pitch of the claw and the pitch of the step difference portion are set to a natural number times the pitch P22 of the tube 22, and the claw and the step difference portion are disposed to correspond to the gap between adjacent two of the tubes 22.

In addition, in the above embodiments, there are formed numeral clamping sections by bending all the claws 35. In place of this, the claws 35 may be bent only partially. In this case, the remaining claws 35 are in a straight shape that is not bent. For example, the claws 35 may be bent only at a position of twice the pitch P22 of the tube 22. In addition, in the vicinity of an inlet pipe and/or an outlet pipe of the internal fluid, the claws 35 that are not bent may be provided in order to facilitate the processing.

In the above embodiments, the waved outer surface and the waved inner surface are formed in curved surfaces that are smoothly successive. In place of this, the waved outer surface and the waved inner surface may be configured to have a plurality of plane surfaces. For example, the waved outer surface and the waved inner surface may be formed in trapezoidal wave shapes or rectangular wave shapes.

In the above embodiments, the tank member 27 is made of a resin. In place of this, the tank member 27 may be made of the metal such as the aluminum alloy.

The disclosure hereinbefore is not limited to the embodiments to carry out the disclosure at all, and thus, it is possible to embody various modifications. The disclosure is not limited to the combinations described in the embodiments, and thus, it is possible to make embodiments of the disclosure through various combinations. The embodiments can have additional parts. Some parts of the embodiments may be omitted. Some parts of the embodiments can be replaced or assembled with parts of other embodiments. The configuration, operation and effect of the embodiments are merely the examples. The technical scope of the disclosure is not limited to the description of the embodiments. Some of technical scope of the disclosure is expressed through the description of Claims and is understood to include all the changes within the meaning and the scope equivalent to the description of Claims.

The invention claimed is:

1. A heat exchanger comprising:

a plurality of tubes;

a core plate to which the plurality of tubes are bonded; and a tank member connected to the core plate, wherein an edge of the core plate and an edge of the tank member are connected to each other by a clamping section, the clamping section has a plurality of claws provided on the edge of the core plate, an edge portion provided on an opening end of the tank member, and a waved wall provided in the tank member along a length direction in a wave shape, the waved wall has a waved outer surface that is provided on an outer surface above the edge portion and that includes a plurality of outer ridge portions and a plurality of outer valley portions which are disposed alternately, and a waved inner surface that is provided on an inner surface of the tank member and that includes a plurality of inner ridge portions and a plurality of inner valley portions which are disposed alternately, each of the plurality of outer valley portions receives each of the plurality of claws and has a step surface in contact with the claw, which is formed on the edge portion, each of the plurality of inner ridge portions is positioned inside each of the plurality of outer valley portions in a width direction, and an inner width of the tank member regulated by the plurality of inner ridge portions is narrower than a width of each of the plurality of tubes, and wherein each of the plurality of inner ridge portions is not positioned between adjacent tubes and positioned on a region between each of the plurality of tubes in the extension of each of the plurality of tubes in a height direction, and each of the plurality of inner valley portions provides a space in the extension of each of the plurality of tubes in the height direction.

2. The heat exchanger according to claim 1, wherein each of the plurality of claws has a tapered shape.

3. The heat exchanger according to claim 1, wherein a pitch of the plurality of claws and a pitch of waves of the waved wall are as wide as a natural number "n" times a pitch of the plurality of tubes.

4. The heat exchanger according to claim 1, wherein the core plate has a bottom plate bonded with the plurality of tubes and a lateral plate rising from an edge of the bottom plate, the plurality of claws are provided on an end of the lateral plate, and a size of each of the plurality of claws in the length direction is smaller than a gap between adjacent two of the tubes.

5. The heat exchanger according to claim 1, further comprising:

a gasket provided between the edge portion and the core plate.

6. The heat exchanger according to claim 5, wherein the tank member is made of a resin, and the core plate and the tank member are connected to each other by only the clamping section.

7. The heat exchanger according to claim 1, further comprising:

an additional clamping section including an additional claw formed on a shorter side of the core plate and an additional step surface formed on a shorter side of the tank member so that the clamping section is provided on only longer sides of the core plate and the tank member.

* * * * *